US008302808B2

(12) United States Patent
Lin et al.

(10) Patent No.: US 8,302,808 B2
(45) Date of Patent: Nov. 6, 2012

(54) CLOSURE DEVICE WITH A PIVOTED DOOR

(75) Inventors: Chia-Hsien Lin, Taipei Hsien (TW); Yung-Feng Lin, Taipei-Hsien (TW); Zhong-Hui Mao, Taipei-Hsien (TW)

(73) Assignee: Wistron Corporation, Taipei Hsien (TW)

( * ) Notice: Subject to any disclaimer, the term of this patent is extended or adjusted under 35 U.S.C. 154(b) by 377 days.

(21) Appl. No.: 12/814,176

(22) Filed: Jun. 11, 2010

(65) Prior Publication Data

US 2011/0011001 A1 Jan. 20, 2011

(30) Foreign Application Priority Data

Jul. 15, 2009 (CN) ..... 2009 2 0164064 U

(51) Int. Cl.
*B65D 51/04* (2006.01)

(52) U.S. Cl. ..... 220/843; 220/810; 220/836; 49/394; 312/329; 16/262; 16/263; 16/271; 16/229

(58) Field of Classification Search ..... 220/810, 220/836, 841, 843, 844; 16/262, 263, 271, 16/229; 49/394, 388, 399, 463, 465; 312/326, 312/329, 245

See application file for complete search history.

(56) References Cited

U.S. PATENT DOCUMENTS

| | | | | |
|---|---|---|---|---|
| 585,510 | A * | 6/1897 | Clarke | 49/188 |
| 3,040,848 | A * | 6/1962 | Powell et al. | 52/797.1 |
| 4,390,114 | A * | 6/1983 | Sviatoslavsky et al. | 220/4.02 |
| 4,482,023 | A * | 11/1984 | Dziedzic et al. | 180/89.17 |
| 4,570,290 | A * | 2/1986 | Anderson | 16/229 |
| 5,259,091 | A * | 11/1993 | Mordick | 16/262 |
| 5,327,682 | A * | 7/1994 | Holtz | 49/463 |
| 5,394,966 | A * | 3/1995 | Chow | 190/119 |
| 6,128,807 | A * | 10/2000 | Lim et al. | 16/266 |
| 2008/0295285 | A1 * | 12/2008 | Clymer et al. | 16/223 |
| 2009/0134755 | A1 * | 5/2009 | Lakoduk et al. | 312/326 |

* cited by examiner

*Primary Examiner* — Jacob K Ackun
*Assistant Examiner* — Jenine Pagan
(74) *Attorney, Agent, or Firm* — Brinks Hofer Gilson & Lione

(57) ABSTRACT

A closure device includes: a main body having first and second shoulders; a door secured rotatably to the main body and having first and second door edges; an engaging member; an engaging mechanism; and a second pivot axle. The first shoulder and the first door edge respectively have a through hole and a first axle hole. The engaging member and the engaging mechanism are disposed respectively at an inner side of the main body. The engaging member includes a first pivot axle extending through the through hole and the first axle hole, and a positioning piece extending radially from the first pivot axle and engaging the engaging mechanism. One of the second shoulder and the second door edge has a second axle hole, while the other of the second shoulder and the second door edge has the second pivot axle extending through the second axle hole.

11 Claims, 9 Drawing Sheets

CLOSURE DEVICE WITH A PIVOTED DOOR

CROSS-REFERENCE TO RELATED APPLICATION

This application claims priority of Chinese Application No. 200920164064.X, filed on Jul. 15, 2009.

BACKGROUND OF THE INVENTION

1. Field of the Invention

The present invention relates to a closure device, more particularly to a closure device with a pivoted door.

2. Description of the Related Art

A conventional closure device with a pivoted door has a hole in each of two sides of the door and two pivot axles formed integrally on a main body of the closure device. Each of the pivot axles extends through a corresponding one of the holes such that the pivoted door is capable of rotating relative to the main body of the closure device.

In the above-mentioned design, when assembling the door to the main body, the door needs to be deformed slightly so as to extend respectively the pivot axles through the corresponding holes. Therefore, the length of each pivot axle must not be too long. Otherwise, the door cannot be assembled to the main body through deformation. However, since the load bearing ability of each pivot axle is limited by the length thereof, the size of the door is limited accordingly.

SUMMARY OF THE INVENTION

Therefore, an object of the present invention is to provide a closure device that is suitable for use with pivoted doors with various sizes.

Accordingly, the closure device with a pivoted door of the present invention includes a main body, a door, a first pivot device, and a second pivot device. The main body has a first shoulder edge that is formed with a through hole, and a second shoulder edge that is opposite to the first shoulder edge. The main body further has an outer side and an inner side with an inner wall face. The door is secured rotatably to the outer side of the main body, and includes a first door edge and a second door edge opposite to the first door edge. The first door edge is formed with a first axle hole aligned with the through hole in the first shoulder edge. The first pivot device includes an engaging member and an engaging mechanism. The engaging member is disposed at the inner side of the main body, and includes a first pivot axle that extends through the first axle hole and the through hole, and a positioning piece that extends radially from a section of the first pivot axle. The engaging mechanism is disposed at the inner wall face for engaging the positioning piece. The second pivot device includes a second pivot axle that is disposed at one of the second shoulder edge of the main body and the second door edge of the door. The other of the second shoulder edge of the main body and the second door edge of the door is formed with a second axle hole through which the second pivot axle extends.

Preferably, the engaging mechanism has a first engaging part and a second engaging part. The positioning piece of the engaging member has a periphery that abuts against the first engaging part so as to limit movement of the engaging member along an axial direction of the first pivot axle. The positioning piece further abuts against the second engaging part so as to prevent rotation of the positioning piece about the first pivot axle.

Preferably, the first engaging part of the engaging mechanism has a plurality of rib protrusions that are spaced apart from each other and that abut against the periphery of the positioning piece of the engaging member.

Preferably, the second engaging part of the engaging mechanism has a positioning hook and a support piece that is spaced apart from the positioning hook. The positioning hook and the support piece abut respectively against opposite surfaces of the positioning piece of the engaging member.

Preferably, the opposite surfaces of the positioning piece include a first surface and a second surface opposite to the first surface. The second surface is farther from the inner wall face of the main body compared to the first surface. The positioning hook of the second engaging part abuts against the second surface. The support piece abuts against the first surface.

Preferably, the second axle hole is formed in the second door edge of the door, and the second pivot axle is integrally formed with the second shoulder edge of the main body.

Preferably, the main body has a hole-defining wall that defines the through hole. The first pivot device further includes a guide part disposed at the inner wall face of the main body. The guide part has an abutting face that extends integrally from a section of the hole-defining wall. The first pivot axle of the engaging member abuts against the abutting face of the guide part.

Preferably, the first pivot device further includes a support part disposed at the inner wall face of the main body and positioned between the guide part and the engaging mechanism. The support part abuts against the engaging member at a junction of the first pivot axle and the positioning piece.

Preferably, the guide part includes a first section proximate to the through hole and a second section remote from the through hole. The first section has a width greater than that of the second section.

In the present invention, the first pivot axle of the engaging member of the first pivot device is extended through the through hole in the first shoulder edge of the main body and the first axle hole in the first door edge of the door, and the positioning piece on the first pivot axle is designed for engagement with the engaging mechanism at the inner wall face of the main body. This arrangement provides a new assembly method between the main body and the door, and allows the first pivot axle of the first pivot device and the second pivot axle of the second pivot device to have a longer length, and hence provides a large load bearing ability relative to a conventional closure device with a pivoted door, thereby enabling use of a door with various dimensions.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
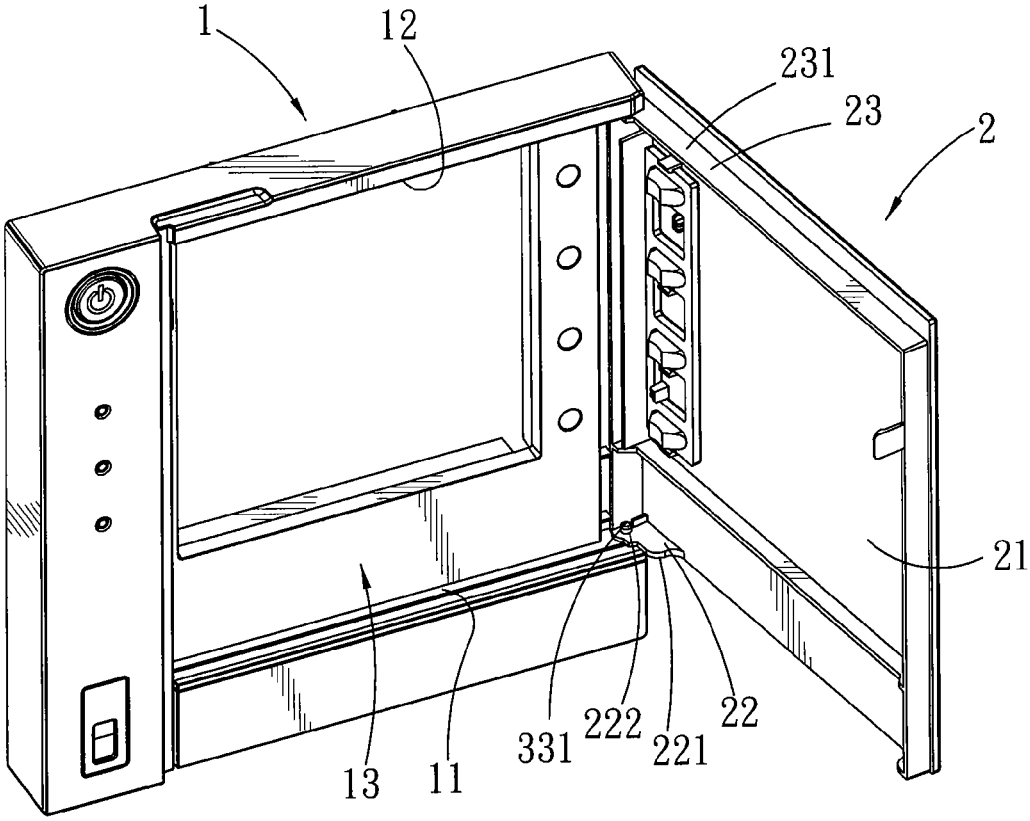
FIG. 1 is a perspective view of the preferred embodiment of a closure device with a pivoted door according to the present invention.
Figure 2:
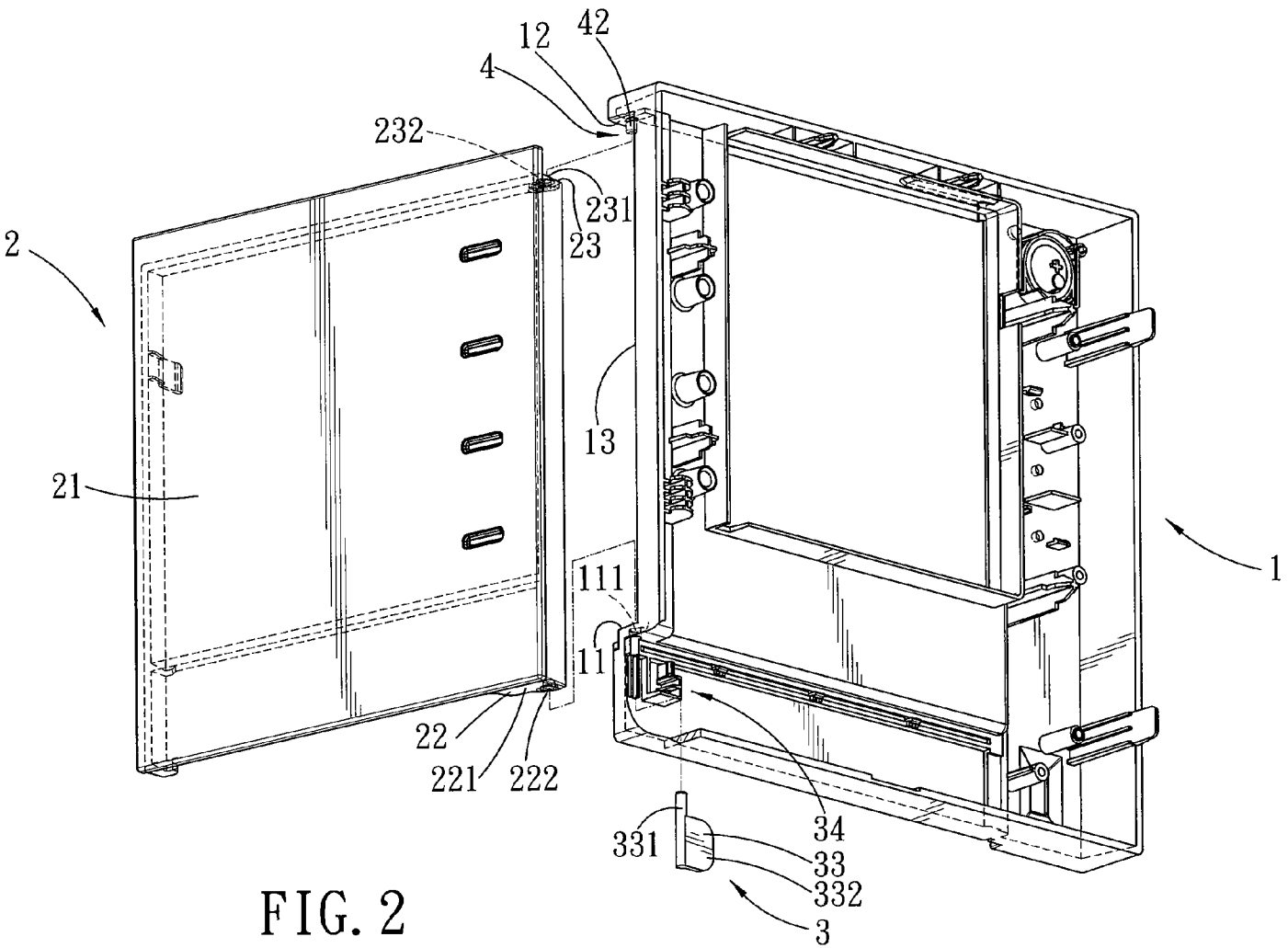
FIG. 2 is an exploded perspective view of the preferred embodiment.

Referring to FIGS. 1 and 2, the preferred embodiment of a closure device with a pivoted door according to the present invention includes a main body 1, a door 2, a first pivot device 3, and a second pivot device 4.

The main body 1 includes a first shoulder edge 11 and a second shoulder edge 12 opposite to the first shoulder edge 11. In the present embodiment, the main body 1 has an outer side that is recessed to form a receiving space 13. The first shoulder edge 11 defines a lower shoulder of the receiving space 13, and the second shoulder edge 12 defines an upper shoulder of the receiving space 13.

The door 2 is secured rotatably to the outer side of the main body 1. The door 2 is received within the receiving space 13 of the main body 1 when the door 2 is closed with respect to the main body 1. The door 2 includes a first door edge 221 and a second door edge 231 opposite to the first door edge 221. In the present embodiment, the door 2 includes a door main body 21, and a first door piece 22 and a second door piece 23 that are connected respectively to the door main body 21 and that are spaced apart from each other. The first door edge 221 is disposed at the first door piece 22, and the second door edge 231 is disposed at the second door piece 23.

Figure 3:
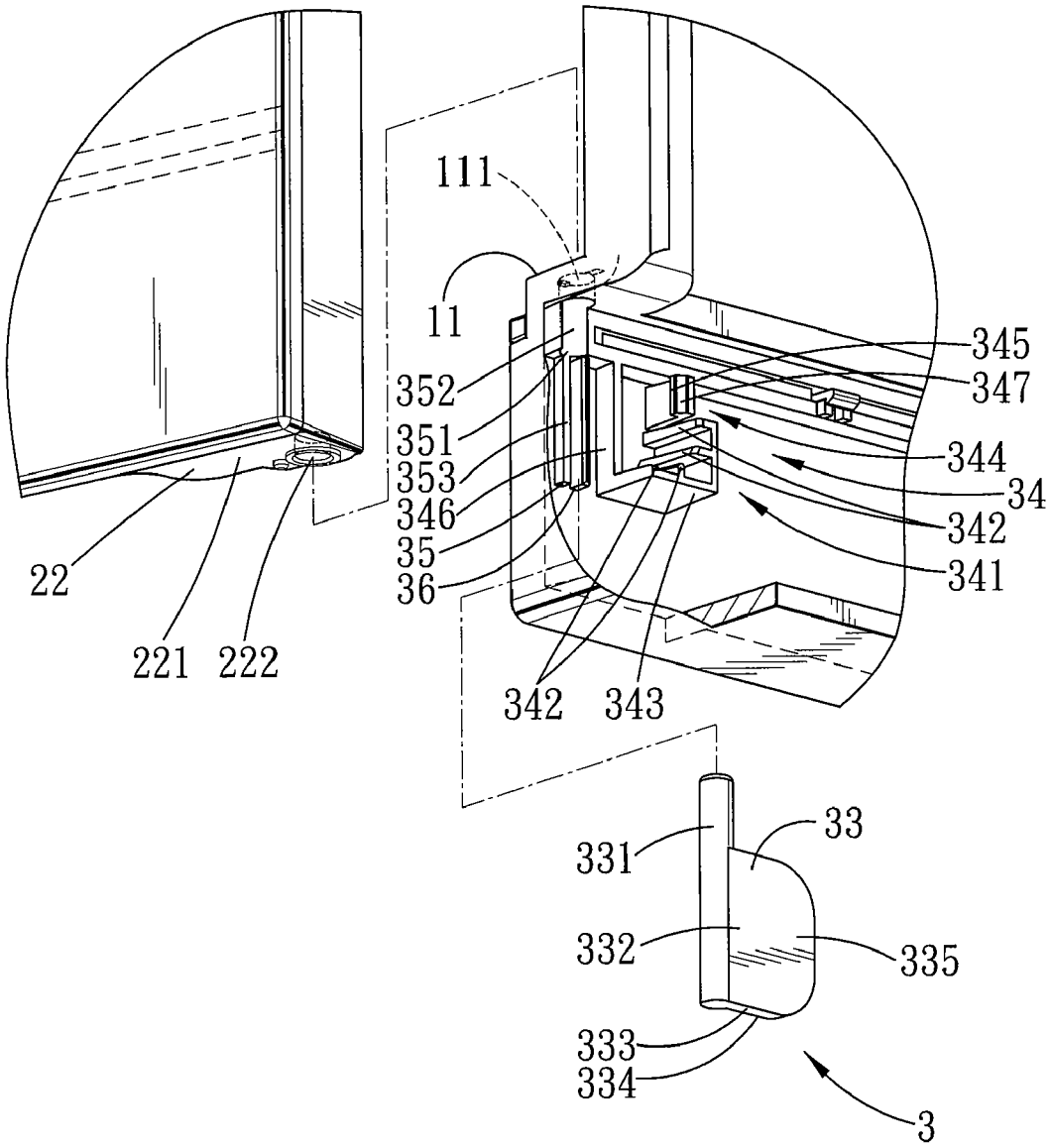
FIG. 3 is a fragmentary enlarged view of FIG. 2 illustrating a first pivot device.
Figure 4:
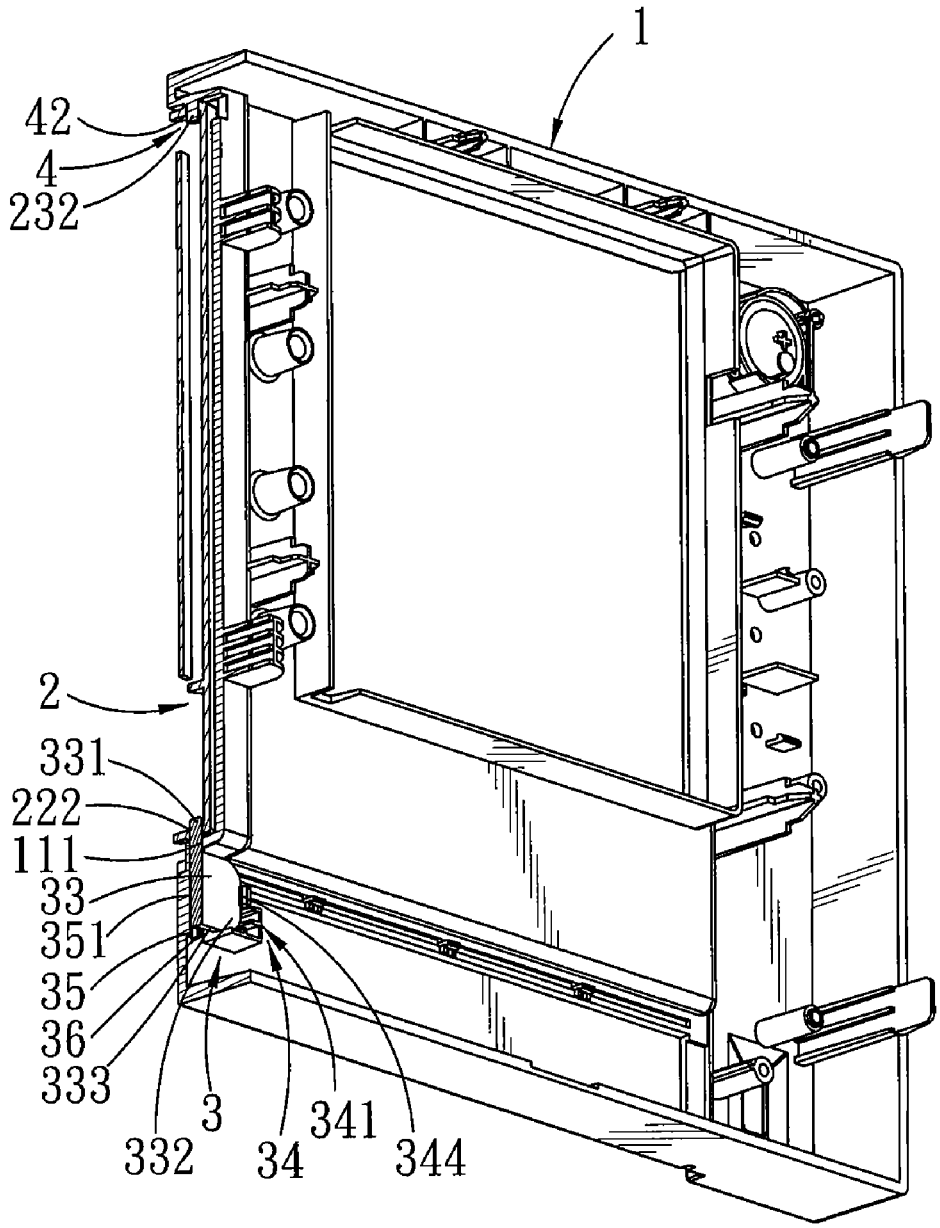
FIG. 4 is a schematic sectional view of the preferred embodiment.
Figure 5:
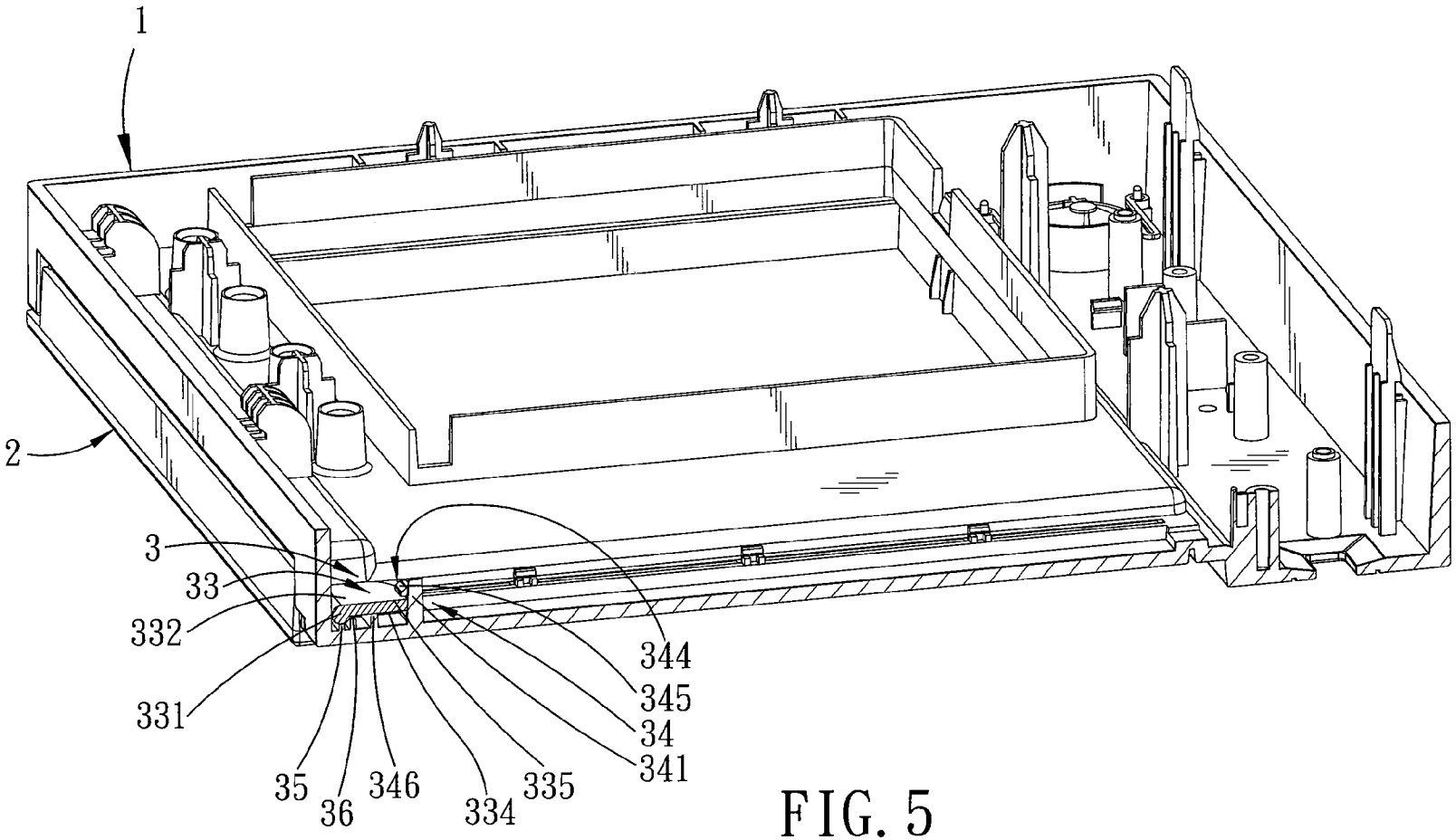
FIG. 5 is another schematic sectional view of the preferred embodiment.

Referring to FIGS. 3, 4, and 5, the first door edge 221 of the door 2 has a first axle hole 222, and the first shoulder edge 11 of the main body 1 has a through hole 111 aligned with the first axle hole 222. The main body 1 defines an inner side with an inner wall face. The first pivot device 3 includes an engaging member 33 disposed at the inner side of the main body 1, an engaging mechanism 34 disposed at the inner wall face of the main body 1, a guide part 35, and a support part 36. The through hole 111 passes the inner and outer sides of the main body 1.

The engaging member 33 includes a first pivot axle 331 extending through the through hole 111 and the first axle hole 222, and a positioning piece 332 extending radially from a section of the first pivot axle 331 for engaging the engaging mechanism 34. The positioning piece 332 has a first surface 334, a second surface 335 opposite to the first surface 334, and a periphery 333. The second surface 335 is farther away from the inner wall face of the main body 1 compared to the first surface 334.

The engaging mechanism 34 has a first engaging part 341 and a second engaging part 344. The first engaging part 341 abuts against the periphery 333 of the positioning piece 332 so as to limit movement of the engaging member 33 along an axial direction of the first pivot axle 331. The second engaging part 344 abuts against the second surface 335 of the positioning piece 332 so as to prevent rotation of the positioning piece 332 about the first pivot axle 331.

In the present embodiment, the first engaging part 341 includes a plurality of rib protrusions 342 that are spaced apart from each other and that abut respectively against the periphery 333 of the positioning piece 332 of the engaging member 33. The first engaging part 341 further includes an L-shaped connecting plate 343 connected to the rib protrusions 342. The rib protrusions 342 limit movement of the positioning piece 332, and hence limit movement of the engaging member 33 along an axial direction of the first pivot axle 331.

The second engaging part 344 of the present embodiment includes a positioning hook 345 and a support piece 346 spaced apart from the positioning hook 345. The positioning hook 345 has an inclined guide face 347 along which the positioning piece 332 can slide to a locked position. At the locked position, the positioning piece 332 is locked in place by the positioning hook 345 such that the positioning hook 345 abuts against the second surface 335 of the positioning piece 332, and the support piece 346 abuts against the first surface 334 of the positioning piece 332. The positioning hook 345 and the support piece 346 cooperate to prevent the positioning piece 332 from rotating, and thus prevent the engaging member 33 from rotating about the first pivot axle 331 of the engaging member 33.

The main body 1 has a hole-defining wall that defines the through hole 111. The guide part 35 of the first pivot device 3 is disposed at the inner wall face of the main body 1. The guide part 35 has an abutting face 351 that extends integrally from a section of the hole-defining wall. That is to say, the abutting face 351 is a concave arcuate face. In the present embodiment, the guide part 35 includes a first section 352 proximate to the through hole 111 and a second section 353 remote from the through hole 111. The first section 352 has a width greater than that of the second section 353. The abutting face 351 of the guide part 35 provides a guiding function for the first pivot axle 331 when the latter is extended through the through hole 111 and the first axle hole 222.

The support part 36 is disposed between the guide part 35 and the engaging mechanism 34. The support part 36 abuts against the engaging member 33 at a junction of the first pivot axle 331 and the positioning piece 332 to provide support when the positioning piece 332 engages the engaging mechanism 34.

Referring to FIGS. 2 and 4, the second door edge 231 of the door 2 has a second axle hole 232. The second pivot device 4 includes a second pivot axle 42 disposed at the second shoulder edge 12 of the main body 1, extending through the second axle hole 232, and formed integrally with the second shoulder edge 12.

It is to be noted that the positions of the second axle hole 232 and the second pivot axle 42 can be interchanged in other embodiment of the invention. That is to say, the second axle hole 232 may be formed in the second shoulder edge 12 of the main body 1, and the second pivot axle 42 may be disposed at the second door edge 231 of the door 2.

In addition, it is to be noted that the second pivot device 4 may adopt the same design as that of the first pivot device 3 in further embodiments of this invention.

Referring to FIGS. 6 to 9, the process of assembling the door to and the main body 1 is described hereinafter.

Figure 6:
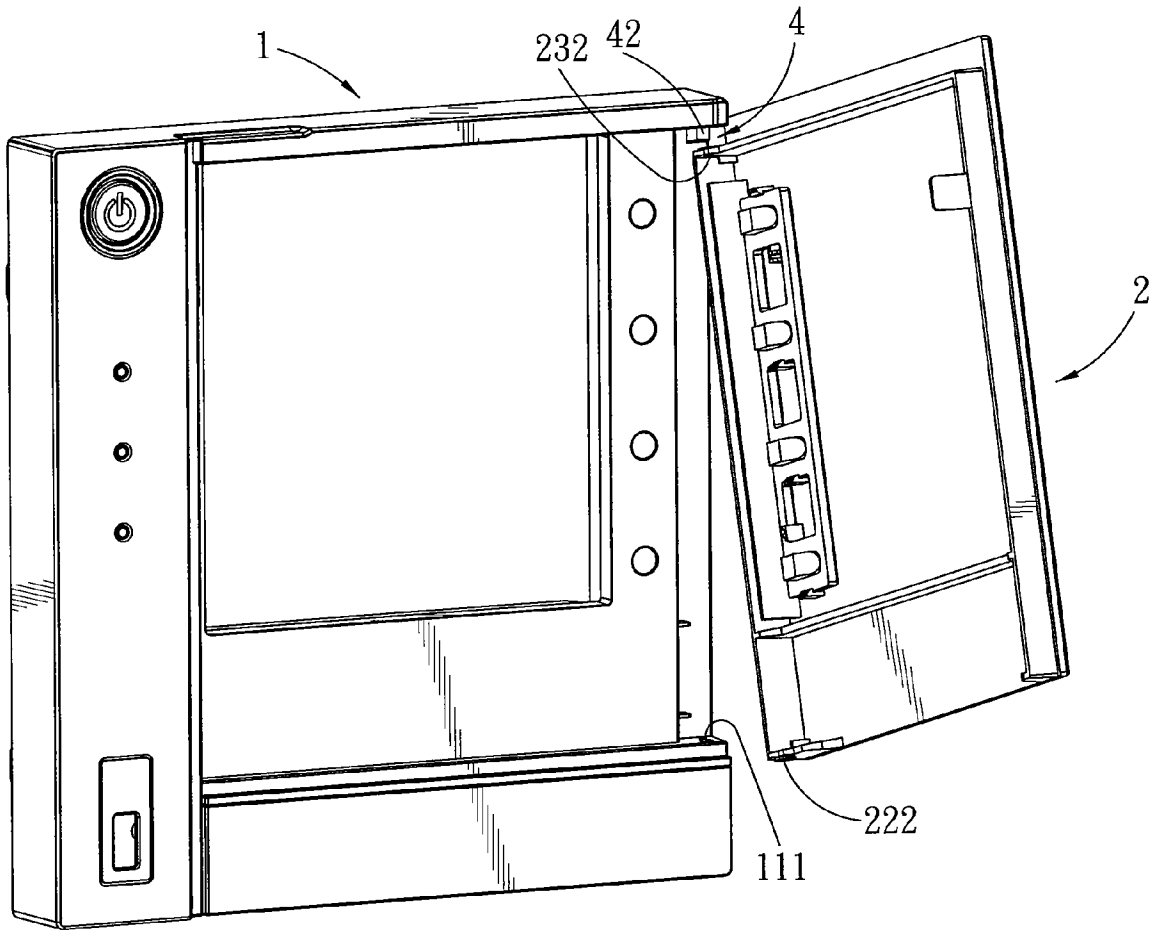
FIG. 6 is a perspective view illustrating a second pivot device in a state of assembling.

Firstly, as shown in FIG. 6, the door 2 is installed at the outer side of the main body 1. The door 2 is tilted and positioned such that the second pivot axle 42 extends through the second axle hole 232. Once the second pivot axle 42 extends through the second axle hole 232, the door 2 is manipulated such that the through hole 111 and the first axle hole 222 are brought into alignment, and the door 2 is closed with respect to the main body 1.

Figure 7:
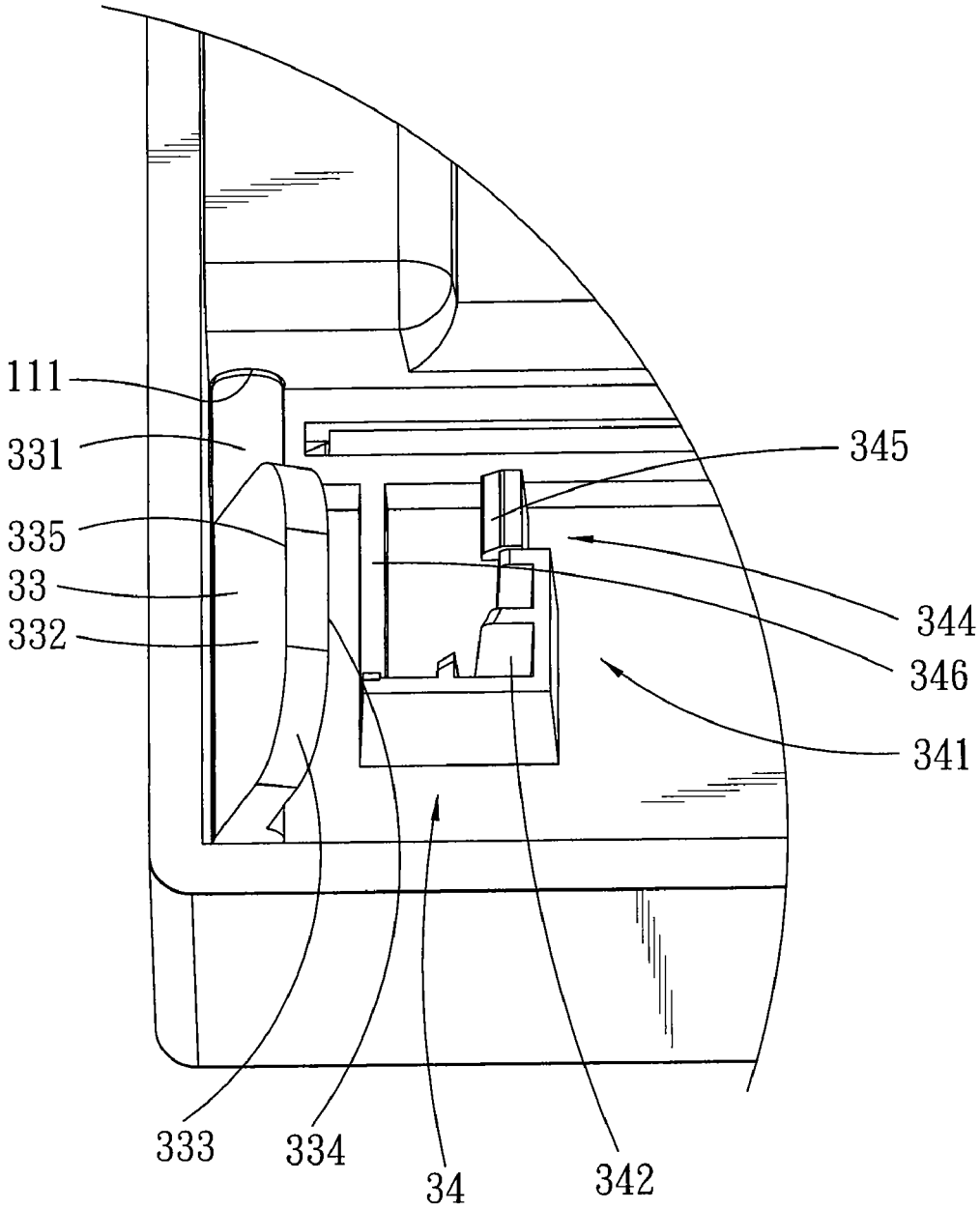
FIG. 7 to FIG. 9 are fragmentary perspective views illustrating the assembly process of the first pivot device.

Secondly, as shown in FIG. 7, at the inner side of the main body 1, the first pivot axle 331 of the engaging member 33 is brought to abut against the guide part 35 (refer to FIG. 3).

Figure 8:
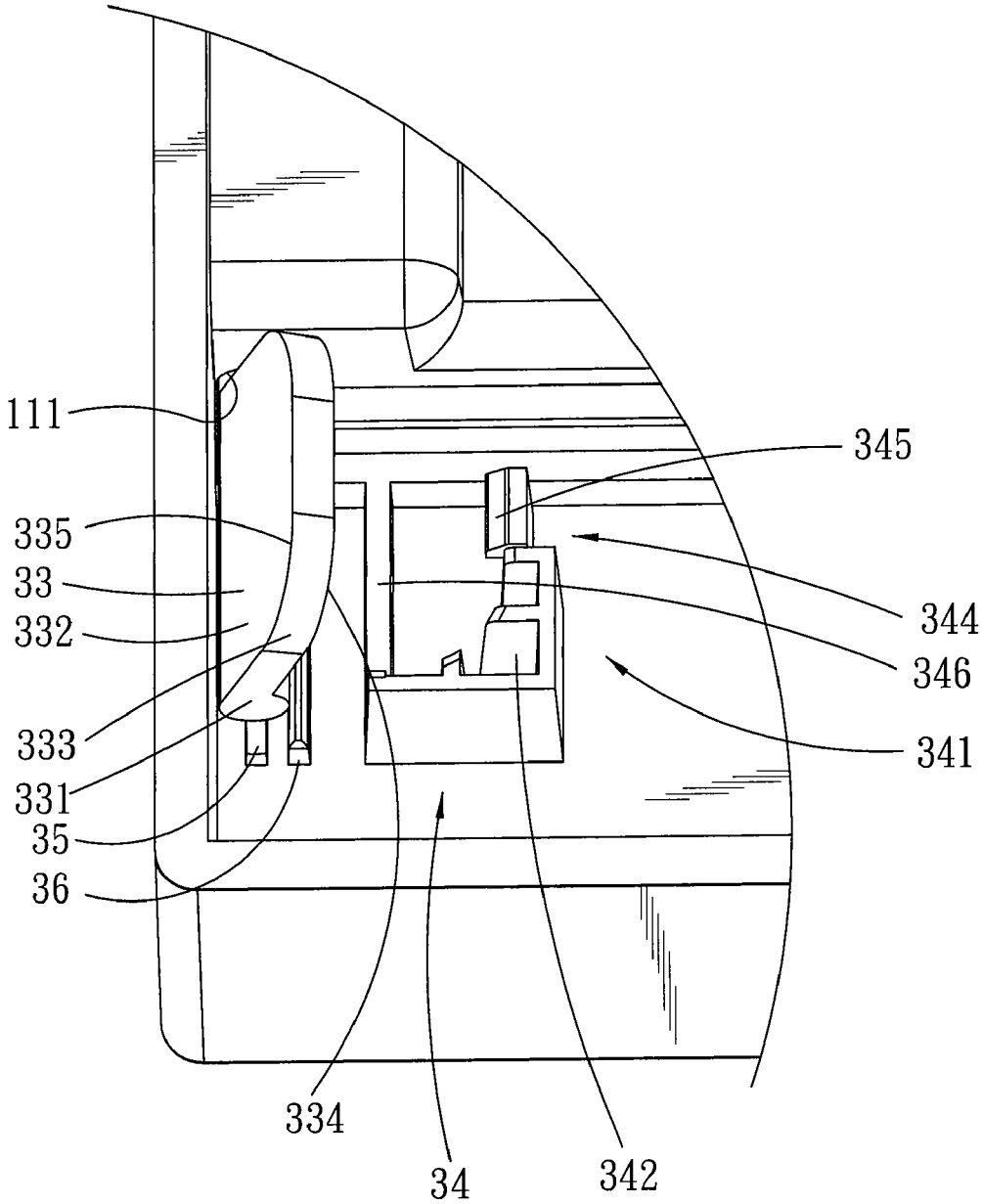

Thirdly, as shown in FIG. 8, the first pivot axle 331 is slid along the guide part 35, and is extended through the through hole 111 and the first axle hole 222 (refer to FIG. 3).

Figure 9:
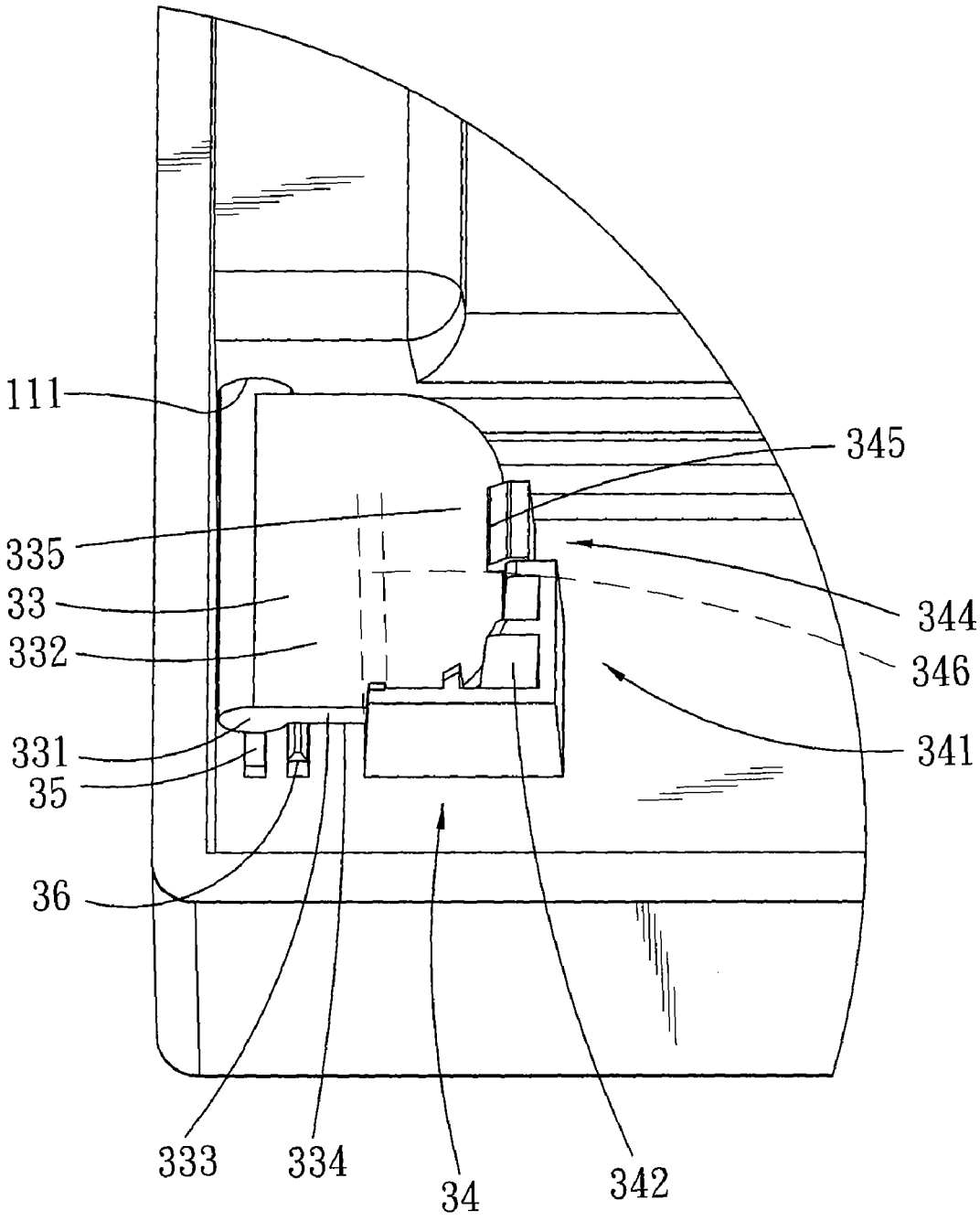

Lastly, as shown in FIG. 9, the positioning piece 332 is rotated until the positioning piece 332 engages the engaging mechanism 34. The rib protrusions 342 abut respectively against the periphery 333 of the positioning piece 332 to limit movement of the positioning piece 332 along an axial direction of the first pivot axle 331. Furthermore, the support piece 346 and the positioning hook 345 abut against the first and second surfaces 334,335 of the positioning piece 332, respectively, to prevent rotation of the positioning piece 332 about the first pivot axle 331. The assembly of the first pivot device 3 is thus completed.

It is to be noted that, because of the above-mentioned assembly process, the first pivot axle 331 of the first pivot device 3 and the second pivot axle 42 of the second pivot device 4 can have a longer length, and hence can provide a large load bearing ability relative to a conventional closure device with a pivoted door, thereby enabling use of a door with various dimensions.

Moreover, the above-mentioned assembly process does not require any tool for completion and is thus convenient to conduct.

In sum, the first pivot axle 331 of the engaging member 33 of the first pivot device 3 is extended through the through hole 111 in the first shoulder edge 11 of the main body 1 and the first axle hole 222 in the first door edge 221 of the door 2, and the positioning piece 332 on the first pivot axle 331 is designed for engagement with the engaging mechanism 34 at the inner wall face of the main body 1. This arrangement provides a new assembly method between the main body 1 and the door 2, and allows the first pivot axle 331 of the first pivot device 3 and the second pivot axle 42 of the second pivot device 4 to have a longer length, and hence provide a large load bearing ability relative to a conventional closure device with a pivoted door, thereby enabling use of a door with various dimensions.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A closure device comprising:

a main body having a first shoulder edge and a second shoulder edge that is opposite to said first shoulder edge, said main body further having an outer side and an inner side with an inner wall face;

a door secured rotatably to said outer side of said main body, said door including a first door edge and a second door edge opposite to said first door edge;

a first pivot device including an engaging member disposed at said inner side of said main body, and including a first pivot axle and a positioning piece that extends radially from a section of said first pivot axle, said first shoulder being formed with a through hole, said first door edge being formed with a first axle hole aligned with said through hole, said first pivot axle extending through said first axle hole and said through hole, and an engaging mechanism disposed at said inner wall face for engaging said positioning piece; and a second pivot device including a second pivot axle that is disposed at one of said second shoulder edge of said main body and said second door edge of said door, the other of said second shoulder edge of said main body and said second door edge of said door being formed with a second axle hole through which said second pivot axle extends.

2. The closure device as claimed in claim 1, wherein said engaging mechanism has a first engaging part and a second engaging part, said positioning piece of said engaging member having a periphery that abuts against said first engaging part, said positioning piece further abutting against said second engaging part.

3. The closure device as claimed in claim 1, wherein said engaging mechanism has a first engaging part and a second engaging part, said positioning piece of said engaging member having a periphery that abuts against said first engaging part so as to limit movement of said engaging member along an axial direction of said first pivot axle, said positioning piece further abutting against said second engaging part so as to prevent rotation of said positioning piece about said first pivot axle.

4. The closure device as claimed in claim 3, wherein said first engaging part of said engaging mechanism has a plurality of rib protrusions that are spaced apart from each other and that abut against said periphery of said positioning piece of said engaging member.

5. The closure device as claimed in claim 3, wherein said second engaging part of said engaging mechanism has a positioning hook and a support piece that is spaced apart from said positioning hook, said positioning hook and said support piece abutting respectively against opposite surfaces of said positioning piece of said engaging member.

6. The closure device as claimed in claim 5, wherein said opposite surfaces of said positioning piece include a first surface and a second surface opposite to said first surface, said second surface being farther from said inner wall face of said main body compared to said first surface, said positioning hook of said second engaging part abutting against said second surface, said support piece abutting against said first surface.

7. The closure device as claimed in claim 1, wherein said second axle hole of said second pivot device is formed in said second door edge of said door, and said second pivot axle of said second pivot device is integrally formed with said second shoulder edge of said main body.

8. The closure device as claimed in claim 1, wherein said main body has a hole-defining wall that defines said through hole, said first pivot device further including a guide part disposed at said inner wall face of said main body, said guide part having an abutting face that extends integrally from a section of said hole-defining wall, said first pivot axle of said engaging member abutting against said abutting face of said guide part.

9. The closure device as claimed in claim 8, wherein said first pivot device further includes a support part disposed at said inner wall face of said main body and positioned between said guide part and said engaging mechanism, said support part abutting against said engaging member at a junction of said first pivot axle and said positioning piece.

10. The closure device as claimed in claim 8, wherein said guide part includes a first section proximate to said through hole and a second section remote from said through hole, said first section having a width greater than that of said second section.

11. The closure device as claimed in claim 8, wherein said second axle hole is formed in said second door edge of said door, and said second pivot axle of said second pivot device is integrally formed with said second shoulder edge of said main body.

* * * * *